US005093965A

United States Patent [19]

Mauras et al.

[11] Patent Number: 5,093,965

[45] Date of Patent: Mar. 10, 1992

[54] PLASTIC BUTTON

[75] Inventors: Jacques Mauras, Grenoble; Guy Andre, Seyssinet Pariset, both of France

[73] Assignee: A. Raymond Kg, Fed. Rep. of Germany

[21] Appl. No.: 587,079

[22] Filed: Sep. 24, 1990

[30] Foreign Application Priority Data

Sep. 23, 1989 [DE] Fed. Rep. of Germany ..... 3931804

[51] Int. Cl.[5] ..... A44B 1/00

[52] U.S. Cl. ..... 24/90 R; 24/92; 24/113 MP

[58] Field of Search ..... 24/90 R, 90 E, 92, 93, 24/94, 108, 113 R, 113 MP; 411/508, 913, 41

[56] References Cited

U.S. PATENT DOCUMENTS

| | | | |
|---|---|---|---|
| 559,906 | 5/1986 | Platt | 24/90 R |
| 582,066 | 5/1897 | Hyde, Jr. | 24/90 R |
| 2,118,561 | 5/1938 | Kleeberg | 24/90 R |
| 3,705,443 | 12/1972 | Camporese et al. | 24/90 R |
| 4,683,621 | 8/1987 | Watanabe | 24/92 |

FOREIGN PATENT DOCUMENTS

| | | | |
|---|---|---|---|
| 763704 | 7/1967 | Canada | 411/41 |
| 0291047A2 | 11/1988 | European Pat. Off. . | |
| 487759 | 4/1977 | Japan | 411/41 |
| 2137476 | 10/1984 | United Kingdom | 24/113 MP |

*Primary Examiner*—Victor N. Sakran

*Attorney, Agent, or Firm*—Finnegan, Henderson, Farabow, Garrett & Dunner

[57] ABSTRACT

A plastic button having a tiltable button cap (1) with a rotationally symmetrical bottom part (3) that can be riveted to a carrier cloth (5) by means of a tack (6). To provide a permanent connection between button cap (1) and bottom part (3) even under frequent tilting motions, there is formed on button cap (1) a hollow shank (2) that terminates at its lower end in an inwardly projecting annular flange (8). The bottom part (3) made separate therefrom has, at is upper end, a conically tapering collar (10) which can be driven into hollow shank (2), with elastic expansion of annular flange (8), and which, in the joined together state, engages with its shoulders (11) behind the annular flnage (8).

4 Claims, 1 Drawing Sheet

FIG.1
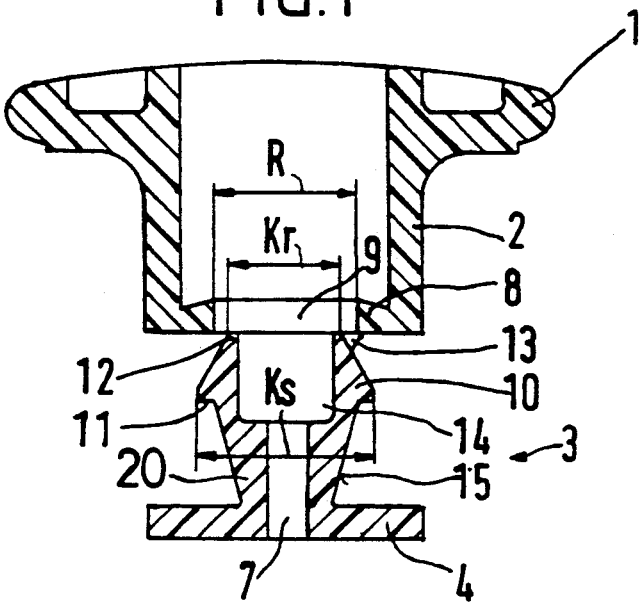
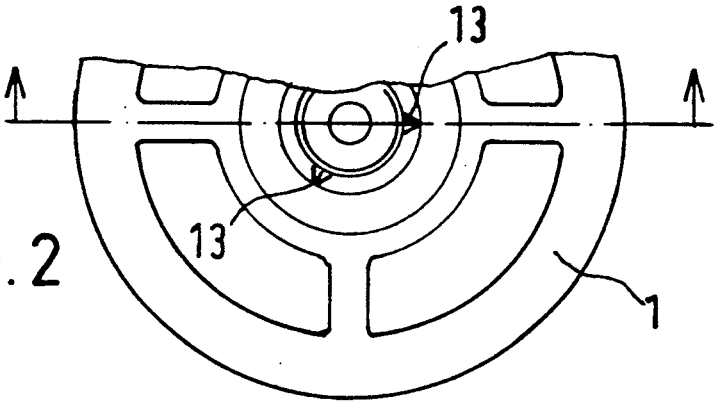
FIG. 2
FIG. 3
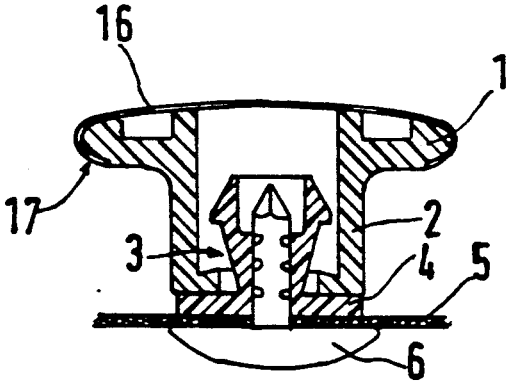
FIG. 4
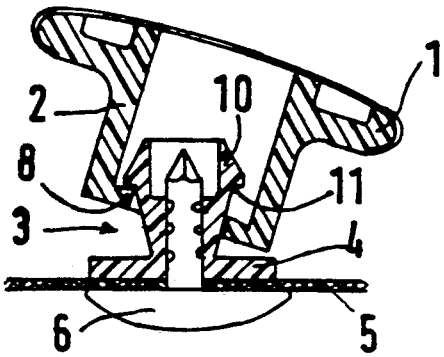

PLASTIC BUTTON

BACKGROUND OF THE INVENTION

This invention relates to a plastic button having an upper tiltable button cap and a rivetable, rotationally symmetrical bottom part.

Such a plastic button is known, for example, from EP 0,291,047 A2. In this button, the button cap is connected to a hollow shank by means of a relatively thin closed wall which first extends inwards from the wide button-cap ring and which then merges in a gentle arc into the cylindrical outer surface of the bottom part. The wall is made flexible over its entire length, so that the button cap can be tilted in any direction by the fingers. Although this thin-walled flexible forming of the button cap on the bottom part affords the advantage that the button cap can be introduced into a buttonhole more easily, nevertheless with frequent use there is the danger that the thin wall will break or tear. Moreover, besides the intended use for buttoning and unbuttoning, "playful" use must also be taken into account.

The object of the invention is, therefore, to design a plastic button of the relevant type, in such a manner that a permanent connection with good tilting properties is obtained between the button cap or plate and the bottom part.

SUMMARY OF THE INVENTION

This object is achieved in accordance with the present invention by providing a plastic button having a rotationally symmetrical bottom part and a tiltable upper part, said upper part having a button cap and a downwardly depending hollow shank that terminates at its lower end in an inwardly projecting annular flange surrounding a central opening and said bottom part having a base plate and an upperwardly extending shaft having at its upper end, an outwardly tapering conical collar that terminates in shoulders spaced from the base-plate, said collar being of a size permitting it to be inserted into the opening in the hollow shank during assembly with elastic expansion of said annular flange so that said shoulders will engage behind the annular flange of the hollow shank to lock the upper part to the bottom part while permitting the upper part to tilt relative to the bottom part. In this manner the button cap together with its shank and the bottom part are injection-molded separately from one another and then joined together in the manner of a press stud.

To make this joining together simpler, according to a preferred embodiment of the invention the upper collar edge of the button part can be connected integrally to the hollow shank of the button plate via at least three tear-off injection-molded webs which are distributed uniformly around the circumference. Thus, the two parts not only can be produced in a single injection mold, but, when joined together, are also at once in the correct position relative to one another, this considerably simplifying the assembly.

BRIEF DESCRIPTION OF THE DRAWINGS

A preferred exemplary embodiment of the invention is illustrated in the drawings and will be explained in more detail below In the drawings:

FIG. 1 is a sectional view through the integrally injection-molded plastic button before the joining together;

FIG. 2 is a partial top plan view of the button plate or cap;

FIG. 3 shows the parts of the button joined together during fastening to a cloth web, and;

FIG. 4 shows the fastened button in a tilted position.

DETAILED DESCRIPTION OF THE INVENTION

The plastic button illustrated in the Figures consists of an upper part having a button plate or cap 1 and a downwardly depending hollow shank 2 formed thereon and a rotationally symmetrical bottom part 3 having a base plate 4 and an upwardly extending shaft 20. Base plate 4 serves to fasten the button to a carrier cloth 5 by means of a tack 6 which is driven from the rear of the cloth 5 into a rivet hole 7 in bottom part 3.

Hollow shank 2 terminates at its lower end in an inwardly projecting, annularly continuous flange 8 that has at its center a hole or opening 9 of a size appropriate for receiving shaft 20 of bottom part 3.

In contrast, the shaft 20 of bottom part 3 has, at its upper end facing hollow shank 2, an outwardly conically tapering collar 10 having shoulders 11 on its lower side spaced from base plate 4 which shoulders, in the assembled state of the button, engage behind annular flange 8 (See FIGS. 3 and 4). The upper edge 12 of collar 10 is somewhat smaller in its outside diameter "Kr" than the diameter "R" of hole 9 of annular flange 8. Before assembly of the two parts, the upper edge of the collar is integrally connected to the flange during molding by three tear-off injection-molded webs 13 (See FIG. 2) that are distributed uniformly around the circumference of the collar and the flange.

The outside diameter "KS" of conical collar 10 at its shoulders 11 is larger than the diameter R of hole 9 so that as it is driven into hole 9 there will be elastic expansion of annular flange 8 and then shoulders 11 will lock behind flange 8. To make the driving in easier, a recess 14, wider in relation to hole 7, is provided in the shaft of bottom part 3 in the region of collar 10, so that the collar 10, when driven into hole 9, will at the same time also be somewhat compressed. Thus, when the shaft 20 of bottom part 3 is being driven into the upper part 1,2 collar 10 will also undergo elastic deformation.

To assist the tilting movement of upper part 1,2 on bottom part 3 (FIG. 4), the outer surface 15 of the shaft 20 of bottom part 3 located below shoulders 11 tapers conically inwardly as far as base plate 4. Thus, annular flange 8 can utilize the entire shoulder width of the collar as a bearing surface and can tilt freely on all sides.

As is customary with buttons of this type, button cap 1 can be equipped with a decorative metal cover plate 16 which is crimped around at its edge 17 behind button cap 1. The button is typically supplied in joined together state, with the cover plate 16 crimped to it. It can easily be riveted to a carrier cloth 5, as shown in FIG. 3, by supporting the shank 2 on base plate 4 by means of annular flange 8, while the tack 6 is driven in from the rear.

We claim:

1. A plastic button comprising a rotationally symmetrical bottom part and a tiltable upper part, said upper part having a button cap and a downwardly depending hollow shank that terminates at its lower end in an inwardly projecting annular flange surrounding a central opening and said bottom part having a base plate and an upwardly extending shaft having at its upper end, an outwardly tapering conical collar that terminates in shoulders spaced from the base plate, the outer side surface of said shaft between the shoulders and the base plate tapering conically inwardly from the shoulders to the base plate, said collar being of a size permitting it to be inserted into the opening in the hollow shank during assembly with elastic expansion of said annular flange so that said shoulders will engage behind the annular flange of the hollow shank to lock the upper part to the bottom part while permitting the upper part to tilt relative to the bottom part.

2. The plastic button of claim 1, wherein the upper edge of the collar is, before assembly of the two parts, integrally connected to the annular flange via a plurality of tear-off webs.

3. The plastic button of claim 1 wherein the shaft of the bottom part has, in the region of the conical collar, a recess permitting inward elastic deformation of the collar during assembly of the two parts.

4. The plastic button of claim 1, wherein the base plate of the bottom part has a diameter corresponding approximately to the outside diameter of the hollow shank of the upper part.

* * * * *